United States Patent [19]

Okada

[11] 4,429,865

[45] Feb. 7, 1984

[54] PAPER FEED DEVICE

[75] Inventor: Osamu Okada, Aichi, Japan

[73] Assignee: Minolta Camera Kabushiki Kaisha, Osaka, Japan

[21] Appl. No.: 296,356

[22] Filed: Aug. 26, 1981

[30] Foreign Application Priority Data

Sep. 11, 1980 [JP] Japan ..... 55-126792

[51] Int. Cl.[3] ..... B65H 3/56

[52] U.S. Cl. ..... 271/170; 271/127

[58] Field of Search ..... 271/170, 171, 127, 22, 271/21, 19, 126, 167, 169, 117, 121, 251

[56] References Cited

U.S. PATENT DOCUMENTS 3,285,601 11/1966 Zeuthen ..... 271/170 X 3,417,988 12/1968 Springer ..... 271/21 X 3,655,182 4/1972 Rilinger ..... 271/170

3,698,706 10/1972 Minojevich et al. ..... 271/9

3,977,666 8/1976 Suzuki et al. ..... 271/170 X

*Primary Examiner*—Bruce H. Stoner, Jr.

[57] ABSTRACT

A paper feed device for a copying machine has plate member for supporting a stack of sheets thereon, and separating pawls turnably supported for movement toward and away from the top sheet of the stack and for lightly pressing on each of the forward end corners of the stack when moved toward the stack to the limit of turning movement. The mounting structure for the separating pawls causes them to be displaced in a direction laterally away from the edge of the stack during the turning of the pawls away from the stack to a lifted position.

7 Claims, 6 Drawing Figures

PAPER FEED DEVICE

BACKGROUND OF THE INVENTION

1. Field of the Invention

The present invention relates to a paper feed device for use in copying machines, printing machines or the like, and more particularly to a paper feeder in which a stack of paper sheets is retained and which has separating pawls for lightly holding the forward corners of the stack so as to feed the sheets one by one from the top of the stack.

2. Description of the Prior Art

Copying machines, printing machines, etc. are generally provided with paper feed devices for feeding stacked sheets one after another by rotating feed rollers in contact with the uppermost sheet. To feed the sheets separately one by one, some devices have separating pawls for lightly holding the forward corners of the stack. With such feed devices, the feed rollers rotate in pressing contact with the uppermost sheet, advancing the sheet in the feeding direction. At this time, the sheet buckles between the feed rollers and the separating pawls, whereby the sheet is separated from the other sheets and delivered from the device.

However, the separating pawls, which are designed to project into the sheet stacking area, are a hindrance to the loading or changing of a stack of sheets. To eliminate this drawback, separating pawls have been proposed which can be pivoted on opposite side plates for laterally confining the sheets to a specified position and which pawls are turned upward when sheets are to be loaded, as disclosed, for example, in U.S. Pat. No. 3,698,706 (Mihojevich et al.). This proposal, nevertheless, is still unable to fully overcome the above-mentioned drawback since the separating pawls are located in the stacking area above the sheet support plate even when turned to an upward position.

SUMMARY OF THE INVENTION

The main object of the present invention is to provide a paper feed device having separating pawls which are retracted from the sheet stacking area when lifted, to assure smooth change or loading of sheets.

Another object of the invention is to provide a paper feed device which comprises restraining plates for laterally confining sheets to a specified stacked position and means for turnably supporting separating pawls on the restraining plates and displacing the separating pawls outward when the pawls are turned to a lifted position, the device thus having a simple construction so that it overcomes the above drawback.

Another object of the invention is to provide a paper feed device having a simple construction which is free of the foregoing drawback and which comprises restraining plates for laterally confining a stack of sheets to a specified position, a separating pawl turnably supported on each of the restraining plates by a loose joint, and a slanting member for outwardly displacing the separating pawl when the pawl is turned to a lifted position.

Another object of the invention is to provide a paper feed device wherein such a mechanism for retracting a separating pawl is incorporated into a cassette which is removably loadable into the main body of a machine.

Still another object of the invention is to provide a paper feed device of the type described above wherein the cassette has in its interior side plates which are movable in accordance with the width of sheets to be fed and which are each equipped with a separating pawl adapted to function as described above.

More specifically the present invention provides a paper feed device comprising a plate for supporting a stack of sheets thereon, a separating pawl turnably supported for lightly pressing each of the forward end corners of the stack, and means for causing the separating pawl to be displaced in a direction away from the stack when the pawl is turned to a lifted position.

The invention further provides a paper feed device comprising a cassette main body removably loadable into the main body of a machine, a plate disposed inside the cassette main body and movable upwardly and downwardly for supporting sheets thereon, side plates for laterally confining the supported sheets to a specified position, a separating pawl turnably supported on each of the side plates, and means for causing the separating pawl to be displaced in a direction away from the sheets by an upward turn of the pawl.

The invention further provides a paper feed device wherein the means for displacing the separating pawl has a slanting member for mounting thereon a bearing member inclined in the displacing direction and turnably supporting the separating pawl.

The invention further provides a paper feed device wherein the means for displacing the separating pawl comprises loose bearing means turnably supporting the separating pawl, means for biasing the separating pawl in a direction opposite to the displacing direction, and a displacing member having a slanting portion for displacing the separating pawl against the biasing force when the separating pawl is turned upward.

DETAILED DESCRIPTION OF THE INVENTION

Figure 6:
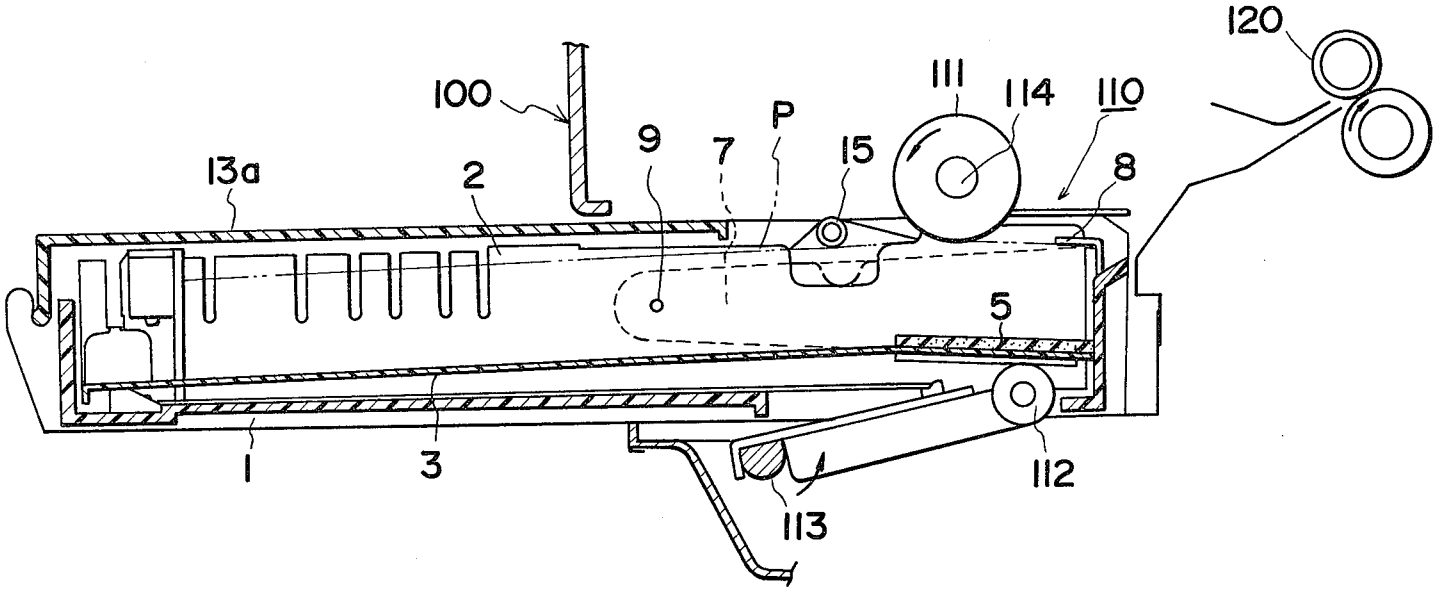
FIG. 6 is a sectional view showing the relation between the cassette and the machine body.

FIG. 6 is a sectional view showing a paper feeding station 110 of the main body 100 of a machine, such as a copying machine. The upper feeding mechanism and its operation will first be described generally with reference to this drawing.

The feeding station 110 of the main body is provided with rotatable feed rollers 111 in a fixed position. A paper cassette 1 removably loadable into the main body 100 has a sheet support plate 3 disposed inside thereof and movable upwardly and downwardly. When the cassette 1 is loaded in place, a lifting member 112 is turned counterclockwise about a pivot 113 to lift the sheet support plate 3, whereby a stack of sheets P on the plate 3 is held in pressing contact with the feed rollers 111. A support member 7 having a separating pawl 8 is pivoted on a pin 9 to each of the opposite side plates 2 in the interior of the cassette. Under gravity, the separating pawl 8 bears on the forward end of the stack of sheets P. The side plates 2 are movable widthwise of the sheets in accordance with the size of sheets to be fed. A friction member 5, for example, of foamed urethane is attached to a forward position of the sheet support plate 3 and opposed to the feed rollers 111. When the stack diminishes to a few sheets, the friction member 5 prevents the sheets from slipping.

A restraining member 15 is mounted on a support 14 which in turn is mounted on the pin 9 supporting the pawl support member 7 so that the restraining member will project and be positioned on the sheet stack for restricting bending of the sheet being fed.

As disclosed in detail, for example, in U.S. Pat. No. 3,977,666 (Suzuki et al.), paper feed devices are well known in which such a cassette is used. Mechanisms similar to those disclosed for loading the cassette and lifting the sheet support plate are also usable for the paper feed device of this invention.

The feed rollers 111 are rotatingly driven, for example, in response to a feed signal produced during the copying operation of a copying machine, whereby only the uppermost sheet P is advanced after being separated from the other sheets by the action of the separating pawls and is sent toward conveyor rollers 120 within the machine.

The present invention is not limited to paper feed devices of such cassette type, but also applicable to those of the type having a stacking station incorporated in the main body of a machine, such as is disclosed in the aforementioned U.S. Pat. No. 3,698,706. However, the invention will be described below as being for a cassette.

Figure 1:
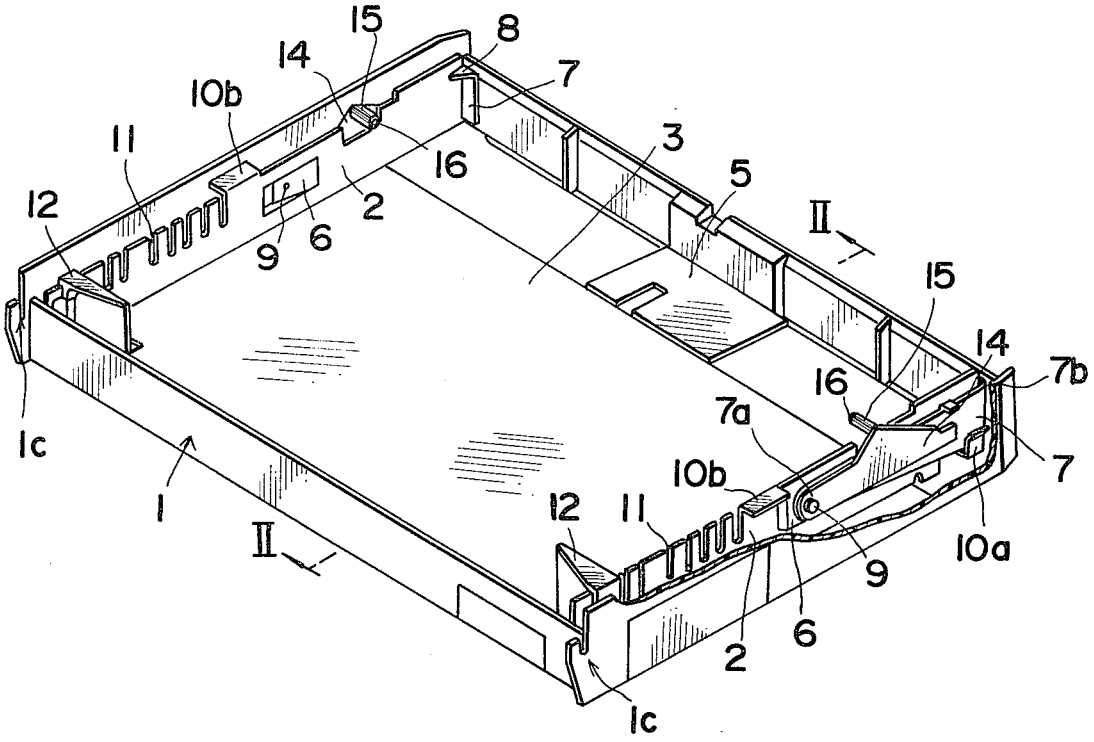
FIG. 1 is a perspective view showing the construction of a cassette of a paper feed device embodying the invention.

A cassette incorporating the present invention will be described below in greater detail with reference to FIGS. 1 to 3.

A cassette main body 1 is in the form of a boxshaped frame and has a bottom 1*a* provided with two opposite side plates 2 which are movable in accordance with the width of paper sheets for laterally confining the sheets to a specified position. A plate 3 for supporting the sheets is disposed between the side plates 2. The plate 3 is turnable, being supported at one end on a projection 1*b* on the bottom 1*a* of the cassette main body 1. The plate 3 is provided, on the under side of the other end thereof, with an elastic sheet 4 for bearing contact with the aforementioned lifting member 112.

A slanting portion 6 is formed approximately at the center of each of the side plates 2 by pinching or otherwise cutting a piece out of the side plate. The slanting portion 6 is bent outward, and has a predetermined angle of inclination with respect to the side plate 2 and is provided with a pivot 9 for turnably supporting a separating pawl support plate 7 at one end 7*a* thereof, the one end 7*a* being bent along the slanting portion 6. The other end 7*b* of the pawl support plate 7 has a separating pawl 8 integral therewith for lightly holding or pressing a forward end corner of the uppermost sheet. The side plate 2 is partly outwardly bent to provide a receiving portion 10*a* and a stop 10*b*. Downward turning of the pawl support plate 7 is limited by the receiving portion 10*a*, and upward turning thereof is limited by the stop 10*b*. Thus the sheet separating pawl 8 is turnable between an operating position in which it is held pressed on the sheet and a non-operating position in which it is released from pressing contact with the sheet and the pawl support plate 7 is in abutting contact with the stop 10*b*. The side plate 2 has a plurality of notches 11 in positions corresponding with the positions of the rear ends of sheets having different sizes. A retaining member 12 is inserted into one of the notches 11 for restraining the rear ends of sheets of the desired size.

Figure 2:
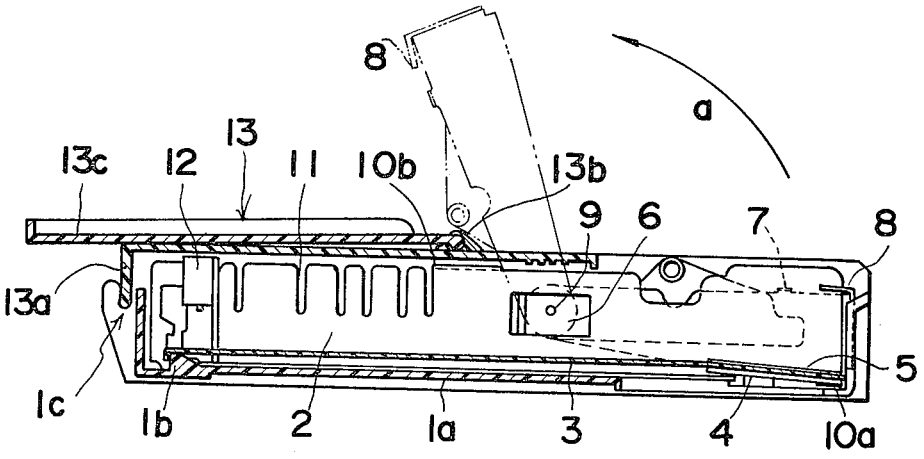
FIG. 2 is a sectional view of the same.

A lid 13 can be attached to the cassette main body 1 (see FIG. 2). The lid 13 comprises a first segment 13*a* turnable about recesses 1*c* formed at the rear end of the cassette main body 1, and a second segment 13*c* as at 13*b* to a forward end portion of the first lid segment 13*a*.

Figure 3:
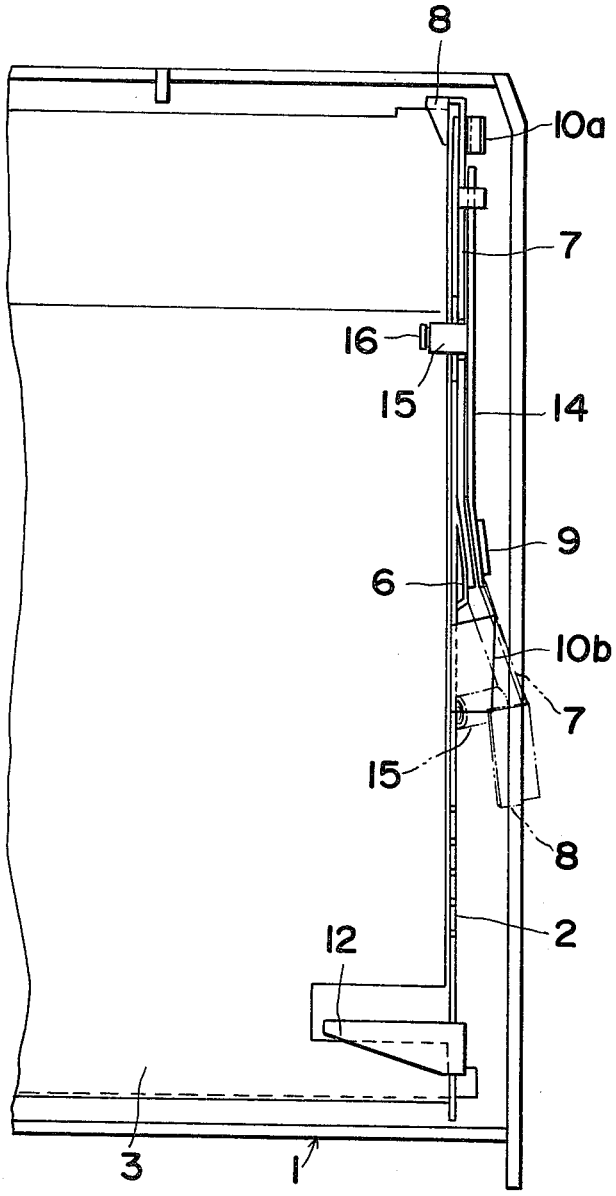
FIG. 3 is a fragmentary plan view of the same.

In the sheet cassette described above, the pawl support plate 7 is turnably supported on the pivot 9 perpendicular to the slanting portion 6 which is at a predetermined angle of inclination to the side plate 2, so that when the separating pawl is turned from the operating position in the direction of arrow a in FIG. 2, the pawl support plate 7 is displaced away from the sheets in the cassette, namely outwardly of the cassette, as indicated in phantom lines in FIG. 3 to retract the separating pawl from the sheet area. The angle of inclination of the slanting portion 6 is suitably determined so that the separating pawl 8 will be held retracted from the sheet stacking area when in the nonoperating position.

Further according to the embodiment described, the pivot 9 mounted on the slanting portion 6 perpendicular thereto turnably supports, together with the pawl support plate 7, a support 14 having a restraining member 15. When turned in the direction of arrow a in the FIG. 2, the support 14, like the pawl support plate 7, is displaced outwardly of the side plate 2 to retract the restraining member 15 from the upper surface of the sheet as illustrated in FIG. 3.

Figure 4:
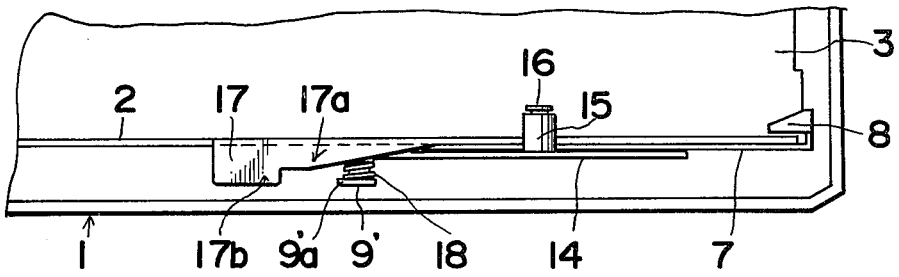
FIG. 4 is a fragmentary plan view showing another embodiment.
Figure 5:
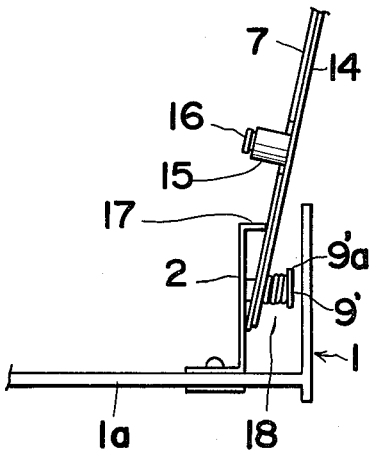
FIG. 5 is a fragmentary side elevation of the same.

FIGS. 4 and 5 show another embodiment of the invention. This embodiment has the same construction as that shown in FIGS. 1 to 3 and FIG. 6 except for the part shown in FIGS. 4 and 5.

With reference to these drawings, the second embodiment is similar to the first in that the support plate 7 for the separating pawl 8 is turnably supported by a pivot 9' on each side plate 2. In the second embodiment, however, the pivot 9' is fixed to the side plate 2 approximately perpendicular thereto, and the support plate 7 is loosely fitted on the pivot 9' and pressed toward the slide plate 2 by a compression spring 18 provided between the support plate 7 and a head 9'*a* on the pivot 9. A cam means 17 having a slanting portion 17*a* and a stop portion 17*b* is formed by bending a portion of the upper edge of the side plate 2 outwardly. When the separating pawl 8 is turned in the lifting direction, the pawl support plate 7 moves along the slanting portion 17*a* and is thereby displaced outwardly of the cassette against the force of the spring 18.

When the pawl support plate 7 is brought into contact with the stop portion 17*b* is a non-operating position, the separating pawl 8 is retracted from above the sheet stacking area.

According to the invention described above, the separating pawl is retracted from above the sheet stacking area when lifted to its non-operating position, enabling the user to load or change sheets without any hindrance. The present device, therefore, has many useful advantages.

I claim:

1. A paper feed device comprising:

a plate member for supporting a stack of sheets thereon;

separating pawls turnably supported for movement toward and away from the top sheet of the stack and for lightly pressing on each of the forward end corners of the stack when moved toward the stack to the limit of turning movement; and means acting on the separating pawls as the pawls are turned away from the stack to a lifted position and displacing said separating pawls in a direction laterally away from the edge of the stack in response to the turning.

2. A paper feed device as claimed in claim 1, wherein said means for displacing the separating pawls comprises a slanting member for each pawl slanting away from the edge of the stack, in the direction of displacement, and a bearing member on each said slanting member turnably supporting a separating pawl.

3. A paper feed device as claimed in claim 1, wherein said means for displacing the separating pawls has loose bearing means turnably supporting the separating pawls, means for biasing the separating pawls in a direction opposite to the displacing direction, and a displacing member having a slanting portion for engagement by the separating pawls for displacing the separating pawls against the biasing force when the separating pawls are turned upward.

4. A paper feed device comprising:

a cassette member removably loadable into a main body of a machine;

a plate disposed inside the cassette member for supporting sheets thereon and movable upwardly and downwardly;

side plates for laterally confining the supported sheets to a specified position;

separating pawls turnably supported on each of the side plates; and means acting on the separating pawls as the pawls are turned away from the stack to a lifted position and displacing said separating pawls in a direction laterally away from the edge of the stack in response to the turning.

5. A paper feed device as claimed in claim 4, wherein said means for displacing the separating pawls comprises a slanting member positioned on each side plate and inclined toward the direction of displacement, and a bearing member on each slanting member turnably supporting the separating pawls.

6. A paper feed device as claimed in claim 5 in which each said bearing member has an axis of rotation around which the pawl mounted thereon is turnable which is perpendicular to said slanting member.

7. A paper feed device as claimed in claim 4, wherein said means for displacing the separating pawls has loose bearing means turnably supporting the separating pawls, means for biasing the separating pawls in a direction opposite to the direction of displacement, and a displacing member associated with each pawl and having a slanting portion for being engaged by the corresponding pawl for displacing the separating pawl against the biasing force when the separating pawl is turned upward.

* * * * *